United States Patent [19]

Wilson

[11] 3,953,925

[45] May 4, 1976

[54] INSTALLATION TOOL AND METHOD FOR INSTALLING A PLURALITY OF WIRES ON AN ELECTRICAL CONNECTOR FRAME

[75] Inventor: Robert Everett Wilson, Agoura, Calif.

[73] Assignee: Viking Industries, Inc., Chatsworth, Calif.

[22] Filed: Dec. 12, 1974

[21] Appl. No.: 531,928

[52] U.S. Cl. ..... 29/628; 29/203 P; 29/203 MW

[51] Int. Cl.[2] ..... H01R 43/00

[58] Field of Search ..... 29/628, 203 R, 203 P, 29/203 HC, 203 J, 203 MW, 203 S, 624; 339/113; 317/99; 174/72 A

[56] References Cited

UNITED STATES PATENTS

| | | | |
|---|---|---|---|
| 3,395,377 | 7/1968 | Straus | 339/113 L |
| 3,758,935 | 9/1973 | Long et al. | 29/203 P |
| 3,772,635 | 11/1973 | Frey et al. | 339/99 R |
| 3,800,390 | 4/1974 | Johnston | 29/203 MW X |
| 3,816,897 | 6/1974 | Long | 29/203 MW X |
| 3,845,535 | 11/1974 | Over | 29/203 P X |
| 3,860,318 | 1/1975 | Reavis et al. | 339/99 R |
| 3,866,297 | 2/1975 | Aldridge et al. | 29/203 MW |
| 3,872,567 | 3/1975 | Cea et al. | 29/203 MW |

*Primary Examiner*—Victor A. DiPalma
*Attorney, Agent, or Firm*—Lindenberg, Freilich, Wasserman, Rosen & Fernandez

[57] ABSTRACT

A tool for installing a set of wires on the rearward portion of a connector frame that has insulation-piercing contact elements for receiving the wires, including a connector-holding arm pivotally mounted on a base and a pair of wire-holding jigs mounted on the base, so that as the arm pivots the wires are severed and pressed into the connector frame. The wire-holding jigs lie on either side of the path of the arm to permit the leading portion of the arm to pass between the jigs, and the jig which holds the cut wire ends that are not installed, lies at a greater angle from the initial arm position than the other jig. The arm includes a cam for applying a large wire-installing force. The tool includes color-coded charts, each having a red or blue color for matching a red or blue cap on a connector frame, to assure that the proper chart is used.

9 Claims, 16 Drawing Figures

Fig. 2
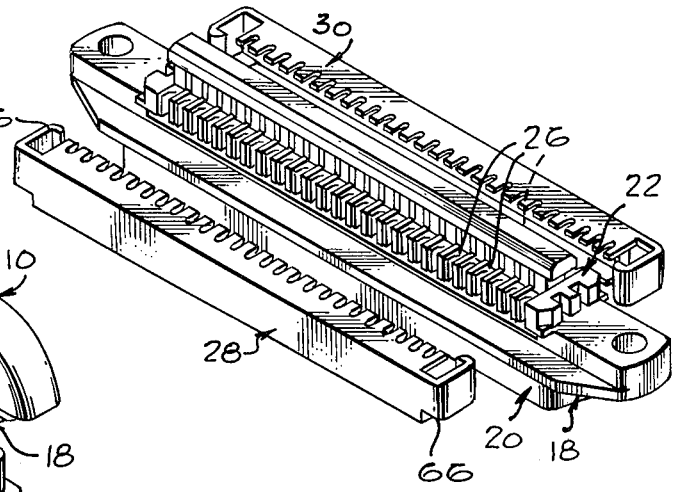
Fig. 1
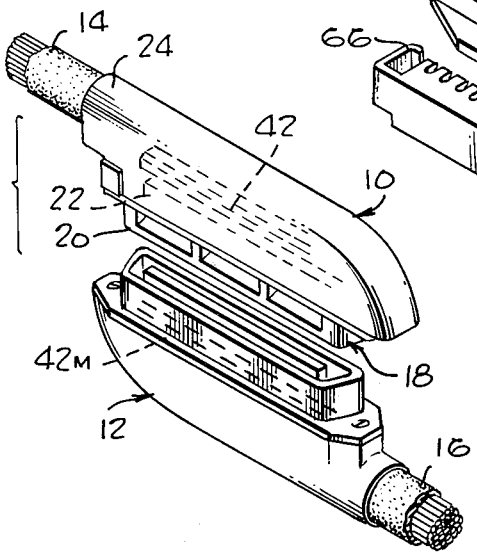
Fig. 3
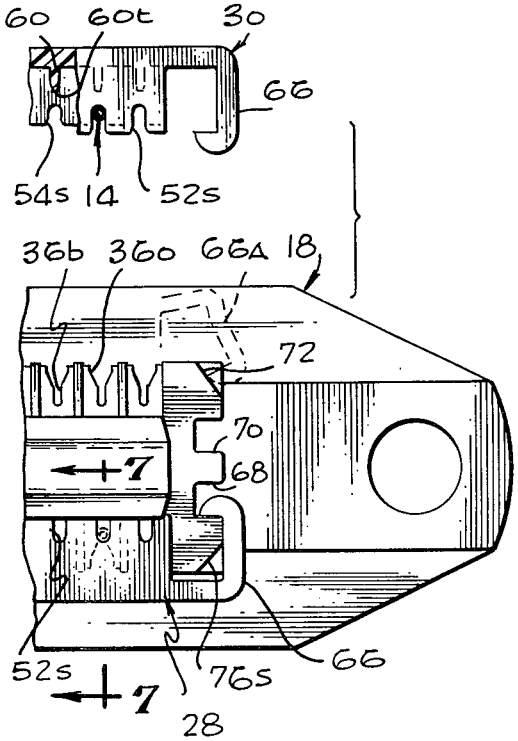
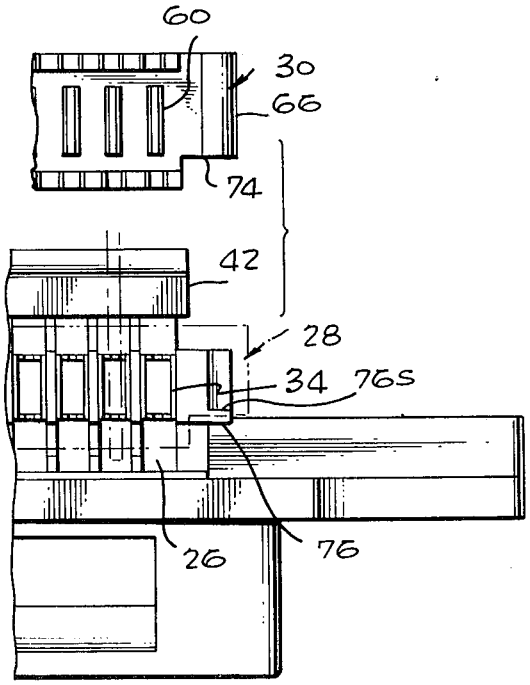
Fig. 4

Fig. 5
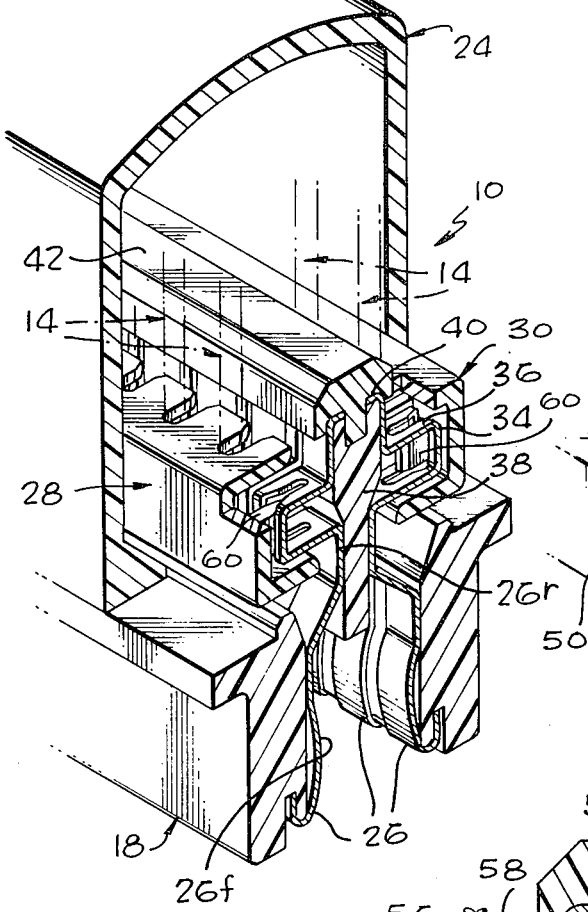
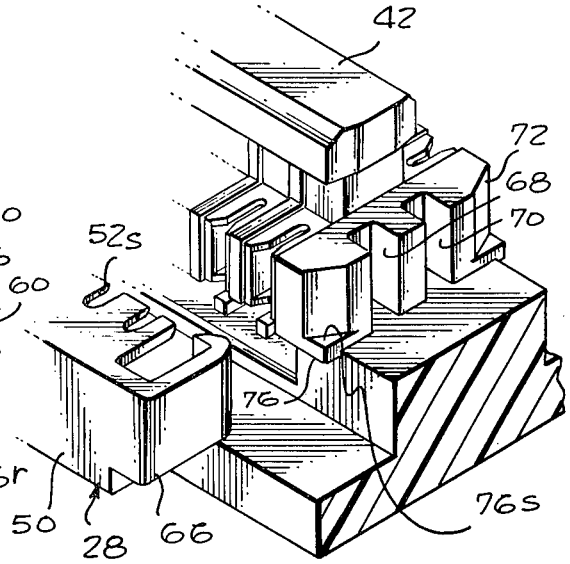
Fig. 6
Fig. 7
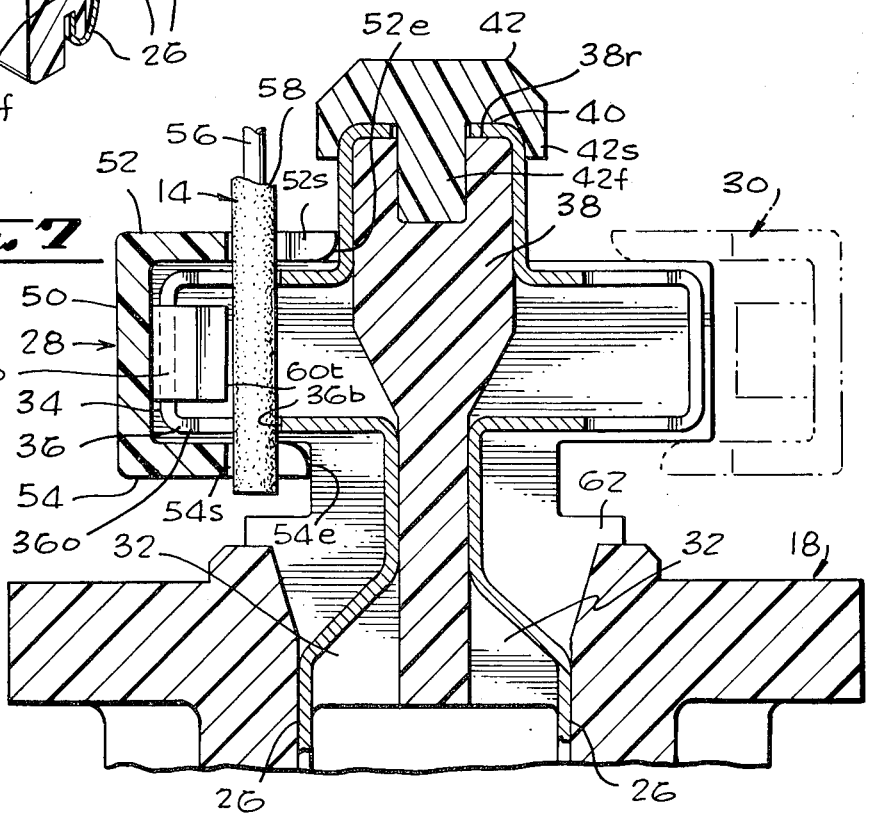

Fig. 8
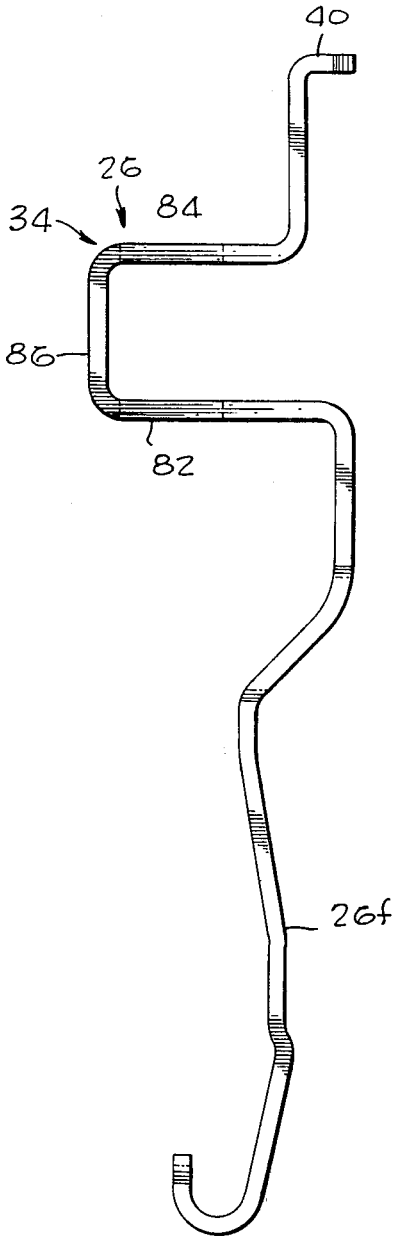
Fig. 10
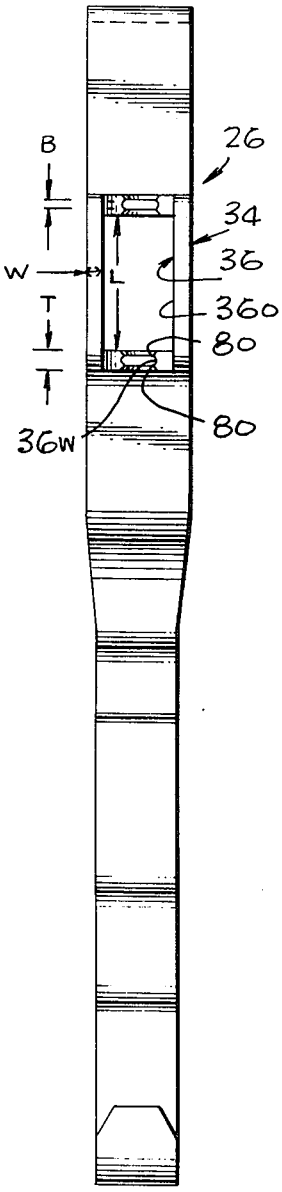
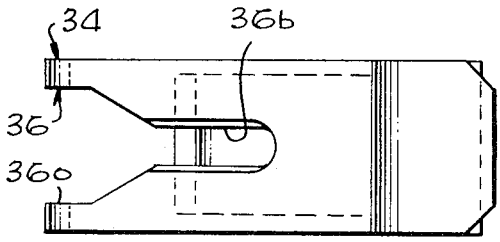
Fig. 9

INSTALLATION TOOL AND METHOD FOR INSTALLING A PLURALITY OF WIRES ON AN ELECTRICAL CONNECTOR FRAME

BACKGROUND OF THE INVENTION

This invention relates to electrical connectors.

One type of electrical connector used in telephone installations, and which is especially useful in field repairs, includes contact elements that have slotted upstanding rearward portions. The slotted portions can pierce the insulation of a wire as it is pressed into the slot, to thereby eliminate the need for stripping the insulated wire or soldering it to the contact element. One type of tool which can be employed to install such wires is described in U.S. Pat. No. 3,758,935, which describes an installation tool having an upstanding arm for holding a connector frame, a pair of pivotable wire-holding jigs, and a pair of pivotable cutting and installing arms. After the connector frame is mounted on the upstanding arm and a group of wires is installed on each of the wire-holding jigs, the jigs are pivoted together towards the connector frame on the arm. Then, the cutting and installing arms are pivoted together so that portions thereof move through slots in the jigs to cut the wires and press them into the connector frames. This arrangement is relatively complicated, inasmuch as it requires pivoting of four different members which move through one another. The two wire-holding jigs must securely hold perhaps 25 wires that each extend to a common cable while the jigs pivot, and the wires must be moved along one of the jigs as the wires are severed and pressed into the connector frame. The tool is often found to be difficult to use because an average person often cannot supply enough force to press two groups of 25 wires each into insulation-piercing contacts. Also, the wrong color-coded chart may be used for installing wires on a connector (i.e., male chart being used for female connector frame or vice versa) because only the rear portion of a connector frame is exposed to view and the rear portions of male and female connector frames may be identical.

SUMMARY OF THE INVENTION

In accordance with one embodiment of the present invention, an installation tool is provided which is relatively simple and which facilitates the installation of a group of wires on a connector frame. The tool includes a stationary base, an arm pivotally mounted on the base for holding a connector frame with the rear portion of the frame exposed, and a pair of wire-holding jig devices mounted on the base for holding a group of wires in extension across the path of the arm. As the arm pivots down, a cutting blade at the leading side of the arm passes across another cutting blade mounted between the wire-holding jigs, to sever the wires so that the cut ends can be installed by wire-pressing means into the connector frame. In order to avoid the necessity for one of the cutting blades and the wire-pressing means to move independently of the wire-holding jigs, one of the jigs that holds the cut ends of the wires that are not to be installed on the connector frame, is located at a greater angle from the initial arm position than the other wire-holding jig, and the jigs are spaced far enough apart to permit the leading portion of the arm to pass between them.

The ability of an operator to apply a sufficiently high force to install a large number of wires onto the wire-piercing contacts of the connector frame, is greatly enhanced by utilizing a camming arrangement. The connector-holding arm has an upper part which can pivot with respect to a lower part, the upper arm part having a cam which can engage another cam on the base when the arm has pivoted down towards the base. After the cams are engaged, an operator can pivot the upper arm part with respect to the lower arm part, so that a large force is applied that urges the connector frame against the wires to assure their proper installation.

The initial stringing of wires on the wire-holding jigs is enhanced by a pair of color-coded charts, one for use with male connectors and the other for use with female connectors. In order to assure that the proper chart will be utilized, the connector frame includes either a red or blue cap on its rearward portion, and each color chart includes either a red or blue stripe. An installer is reminded as to whether a proper or improper chart is being utilized, by the fact that the stripes on the connector frame and chart match or do not match.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a pair of matable electrical connectors, shown prior to mating;

FIG. 2 is a rear perspective and exploded partial view of one of the connectors of FIG. 1, showing the overall shape of the frame and carriers thereof;

FIG. 3 is a rear view of a portion of the connector shown in FIG. 2, with one of the carriers installed and the other shown prior to installation;

FIG. 4 is a partial side elevation view of the carrier of FIG. 3, with one carrier shown prior to installation and the other shown in phantom lines at its installation position;

FIG. 5 is a partial perspective view of the connector of FIG. 2;

FIG. 6 is a partial perspective view of the carrier of FIG. 2;

FIG. 7 is a view taken on the line 7—7 of FIG. 3;

FIG. 8 is a greatly enlarged partial elevation view of the contact element of FIG. 7;

FIG. 9 is a rear elevation view of the contact element of FIG. 8;

FIG. 10 is a side elevation view of the contact element of FIG. 8;

DESCRIPTION OF THE PREFERRED EMBODIMENTS

Figure 11:
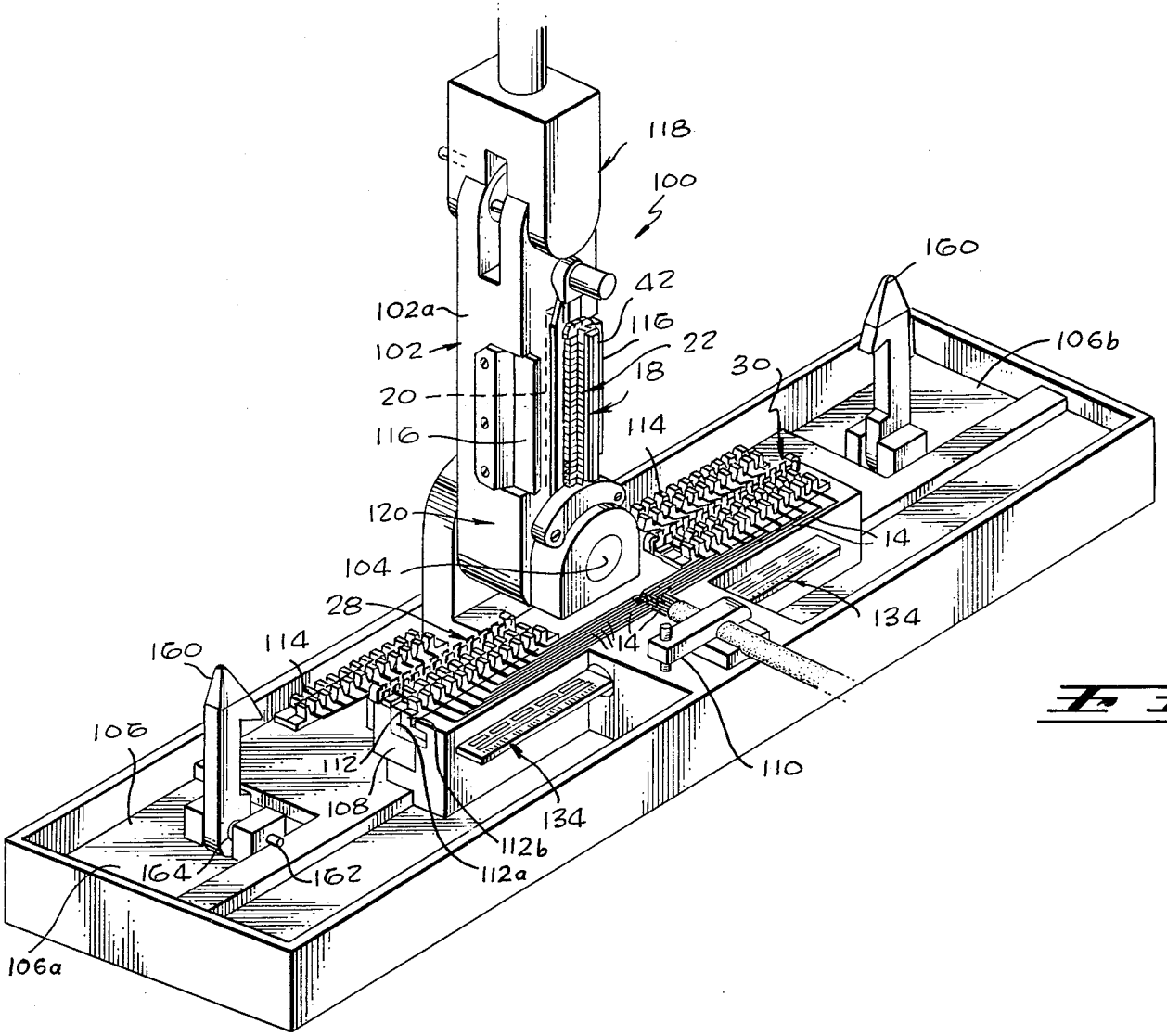
FIG. 11 is a perspective view of an installation tool utilized with the connector of FIG. 5, shown at the beginning of the installation process.

FIG. 1 illustrates a connector assembly which includes a female connector 10 and a male connector 12, which can be mated to interconnect two bundles of wires 14, 16. The female connector 10 includes a frame 18 with a forward or mating portion 20 which is exposed prior to mating of the connectors, and a rearward portion 22 which is covered by a hood 24. As shown in FIG. 2, the rearward portion 22 of the frame holds two rows of electrical contact elements 26 which make electrical connection with the wires of the wire bundle 14 and which also can make mating contact with corresponding contacts of the male connector. A pair of carriers or retainers 28, 30 are designed for installation on the rear portion 22 of the connector frame to aid in the installation of the wires on the contact elements 26, and to hold and protect the wires after they are installed on the contact elements.

As best shown in FIG. 5, the connector frame 18 has two rows of recesses 32 which hold the two rows of contact elements 26 in position. Each contact element 26 has a front or mating end **26*f* designed to engage elements of another connector, and a rearward end 26*r* which is designed to contact the conductor of an insulated wire 14. The rearward end 26*r* of the element has an upstanding portion 34, which has a slot 36 extending therein that is designed to receive and pierce an insulated wire 14. The rearward ends 26*r* of the contact lie against a central rear wall 38 of the connector, with the rearward tips 40 of the contact elements being bent around the central wall to lie on the rearward surface 38*r* of the central rear wall. The rearward tips 40 are securely retained in place by a cap 42 which has a central projection or flange 42*f* received in a corresponding groove at the center of the rearward wall surface 38*r*; the cap flange may be heat welded or otherwise fixed in place in the groove. The cap has a pair of overhanging lips or sides 42*s* which extend around the bent tips 40** of the contact elements to securely hold them in place, and to prevent prying away of a contact element if a wire is pulled out of the element.

In accordance with the present invention, the wires 14 which are received in the contact element slots 36, are securely and protectively retained by the pair of carriers 28, 30. As also shown in FIG. 7, each carrier, such as 28, is an elongated trough-shaped member with a base wall 50 spaced from the central rear wall 38 of the frame, and with rearward and forward carrier side walls 52, 54 which lie respectively rearward and forward of the upstanding contact element portion 34. The rearward carrier wall 52 has a row of slots or grooves **52*s* that are designed to receive the wire 14, while the forward carrier wall 54 has a corresponding row of slots or grooves 54*s* that also can receive the wires. A wire 14 which has a central core or conductor 56 surrounded by insulation 58, is generally installed by first installing the wire on the carrier 28 so that the wire extends through a groove 52*s* of the rearward wall and a groove 54*s* of the forward wall of the carrier. The carrier 28 is then pressed towards the connector frame, with the grooves 52 *s*, 54*s* in the carrier positioned in line with the slot 36 in the contact element 34. The carrier thus forces the wire 14 to enter the slot in the contact element. The outermost portion 36*o* of the slot is wide enough to readily receive and guide the wire into the slot while the deepest or bottommost portion 36*b* of the slot is narrow enough to cut through the insulation of the wire and make contact with the central conductor 56 of the wire. In order to support the wire portion lying between the two walls 52, 54 of the carrier, particularly during installation into the contact element, the carrier is also provided with a row of supports 60 that can help to press the wire into the contact element slot. Each support has a tip 60*t* which is narrower than the outer portion 36*o* of the contact element slots, and the tip 60*t* extends substantially no further from the carrier base wall 50** than the deepest locations or bottoms of the carrier slots.

After the carrier has pressed a row of wires into corresponding contact elements, the carrier is allowed to remain in place on the connector frame to become part of the connector. The carrier 28 is constructed of dielectric, or electrically insulative, material so that it cannot short-circuit the contact elements. The carrier protects the wires 14 by preventing them from falling out of the slots in the contact elements, and also by providing strain relief Strain relief is especially valuable because the portion of the wire immediately forward of the rear carrier wall 52 has been weakened by reason of the fact that the contact element has cut through the insulation and slightly into the central conductor of the wire. In the absence of the carrier 28 or the like to provide strain relief, any sideward pulling on the wire 14 would pull the wire against the sharp walls of the slot 36, which could cause breakage. Of course, the bundle of wires is normally clamped to the hood 24 as it passes out of the connector to provide strain relief, but some wire manipulation and pulling often occurs prior to the final clamping of the bundle of wires to the hood. The carrier 28 automatically provides strain relief at a time immediately after the wire is pierced. The fully installed carrier 28 preferably is positioned so that the tip **52*e* of its upper wall bears against the contact element 26 while the tip 54*e* of its bottom wall presses against an upstanding spacer 62** of the usual type formed in a connector frame. The carrier is therefore restrained against even slight movement, so that it helps to reliably keep the wire in place in the contact element.

As illustrated in FIGS. 2–4 and 6, the carrier is formed with resilient fingers 66 at either end, that serve as retention means for holding the carrier securely to the frame 18. The portion of the frame at either end of the central wall 38 has a pair of longitudinally-extending recesses 68, 70 (FIG. 3) for receiving the ends of the hooks 66 to retain the carriers on the frame. The hooks 66 interlock with the walls of the recesses 66 or 70, to prevent removal by merely pulling out the carrier. The carriers can be attached by merely pressing them against the frame so that the hooks first deflect against beveled surfaces 72 on the frame, as shown at 66A in FIG. 3, and then snap into a corresponding hook-receiving recess 68 or 70 that lie inward of the beveled surface. In order to prevent installation of the carrier in an upsidedown position, the carrier is provided with a cut-away region 74 beneath (or at the forward side) of each hook, and the frame is provided with a barrier 76 that fits into the cut-away region 74. A workman tends to position the hooks directly on the rearward surface **76*s* of the barrier during any hand installation, and therefore the barriers help to encourage installation of the carriers at the proper level at which the rearward and forward walls 52, 54 fit on either side (behind and in front of) of the upstanding contact element portion 34.**

The most common telephone-type connector has 50 contact elements with 25 of them positioned in each row. It is possible to initially install 25 wires on the contact element without the aid of the carriers 28, 30, and with the carriers being later attached for the purpose of retaining and protecting the already-installed wires. However, the easiest and fastest installation can be accomplished through the use of a special installation tool, to be described below, which forces a carrier that is holding 25 wires in its slots against a row of contact elements to install the wires on the contact elements and to install the carrier on the frame.

Occasionally, a repairman will find that a pair of wires have been installed on the wrong contact elements, and therefore the positions of the wires must be interchanged on the contact elements. This can be readily accomplished without special tools, by removing the carrier, interchanging the wire positions, and reinstalling the carrier. Removal of the carrier is easily accomplished by merely applying one's fingernail to a hook 66 to deflect it outwardly so the corresponding end of the carrier can be pulled out, the other end of the carrier being similarly removed.

After the carrier is removed, the wires can be simply pulled out of the contact elements, and can be pushed with one's fingernail into the slot of the proper contact element or can be laid in the proper grooves of the carrier for reinstallation along with the carrier. The carrier can be reinstalled by merely pressing both ends against the frame until the hooks of the carrier snap into position. Even such manually installed wires will operate reliably because the carrier insures full insertion of the wires in the slots and assures their reliable retention. It may be noted that the grooves 52*s*, 54*s* in the carrier normally provide a slight interference fit with the wires 14 (but without cutting into the insulation), to hold the wires in place prior to installation of the carrier and wires on the frame and contact elements.

The upstanding portion 34 of the contact element, which is shown in detail in FIGS. 8–10, is designed to provide good multiple-point contact with the central conductor of an insulated wire. The edges of the slot wall at the outer portion 36*o* of the slot are preferably left flat or even convex so that they do not snag on the insulation. The bottom portion 36*b*, however, is designed not only to cut in a clean manner into the insulation, but also to slightly indent into the central conductor to establish a low resistance connection therewith. To this end, the edge of the bottom portion 36*b* is tapered as from an initial thickness T (FIG. 10) of 0.010 inch to a minimum thickness B of about 0.005 inch. In addition, the wall shown at 36*w* in FIG. 10 is formed to a concave shape to provide a concave edge surface. This leaves a pair of sharp corners at 80 which can readily press a limited distance into the central conductor of the wire to establish low resistance contact therewith. The corners 80 cannot readily penetrate more than a very small depth into the central conductor when urged thereagainst with a moderate force, so that they cannot readily sever the conductor. The upstanding contact element portion 34, which has a pair of upstanding legs 82, 84 joined by a base 86, has eight sharp corners 80 which can contact the central conductor of the wire, with each corner 80 formed to deform into the central conductor by a small distance so as to establish a low resistance contact therewith. It may be noted that the bottom slot portions 36*b* of both legs 82, 84 are of the same width in this embodiment of the invention. It is normally not necessary to leave a wider slot in the rearward leg 84 for strain relief, because the carrier rear wall provides the needed strain relief. Also, the base 86 can be left long and with a width W at either side of the slot 36*o* approximately equal to the very small thickness T of the strip of metal from which the contact element is made. The narrow width W and long length L at each side of the base portion can be provided, even though this leaves the base portion 36 too weak to substantially strengthen the legs 82, 84, because sufficient protection of the wire is provided by the carrier 28. If desired, it is possible to use a simple upstanding plate with a slot in its upper end, as the upstanding portion that receives and cuts into the wire, although the illustrated contact element design provides a rearward tip 40 that can be captured to more securely retain the contact element.

INSTALLATION TOOL

FIGS. 11–16 illustrate details of an installation tool 100 which can be utilized to install a group of wires 14 on a connector frame 18 that has rows of contact elements. The installation process is basically carried out by attaching the connector frame 18 to an installing arm 102 that pivots about an axis 103 on an axle 104 which is mounted on a base 106, and mounting each of the carriers 28, 30 in carrier holders 108 that are positioned on the base. The bundle of wires 14 are then fixed by a clamp 110 to the base, and each of the wires is threaded through the proper slots of wire holders or jigs 112, 114 so that the wires lie in the corresponding grooves of the carriers 28,30. The arm 102 is then pivoted down across one of the carriers 28 at one side 106*a* of the base to press the connector frame 18 against the carrier 28, so that the carrier and wires therein are forced against the connector frame. During such downward movement, a blade 116 on the arm cuts off the wires 14 to the proper length.

At the end of the downward movement of installation arm 102, sufficient force may not have been applied all along the length of the carrier to force all 25 wires therein and the carrier into place on the connector frame. A large final installing force is applied by pivoting an upper part 118 of the installing arm with respect to a lower part 120 thereof, as shown in FIG. 12, to provide a camming action that forces the connector frame 18 hard against the carrier 28. The installing arm 102 is then lifted back to the vertical position of FIG. 11, but with the wires 14 and carrier 28 installed on the frame. Then, the arm 102 is pivoted in the opposite direction towards the other carrier 30 on the other side 106*b* of the base to cut the other wires and install them and the carrier 30 onto the connector frame. The opposite sides of the installation tool 100 which support the different carriers 28, 30 are substantially mirror-image replicas of each other.

Figure 13:
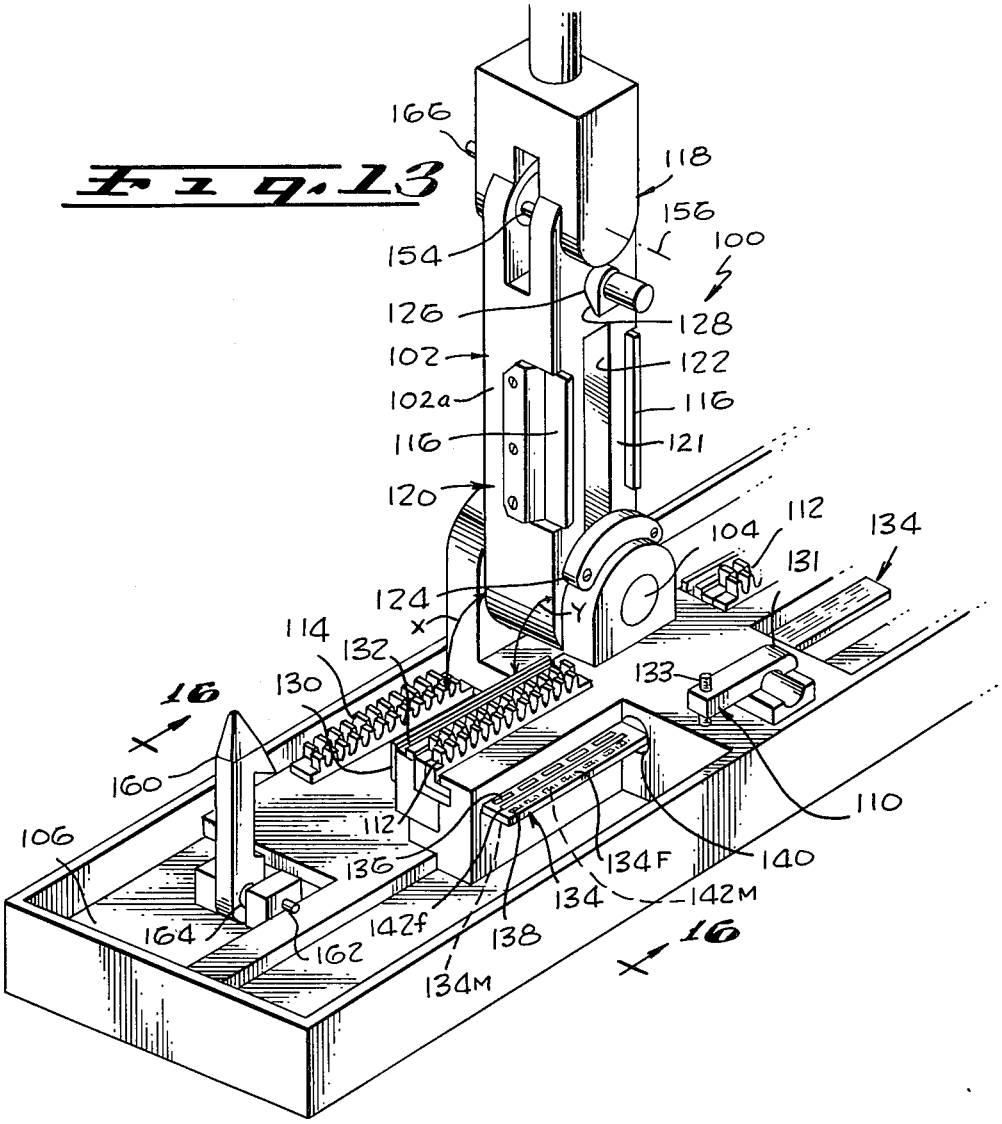
FIG. 13 is a partial perspective view of the installation tool of FIG. 11.
Figure 16:
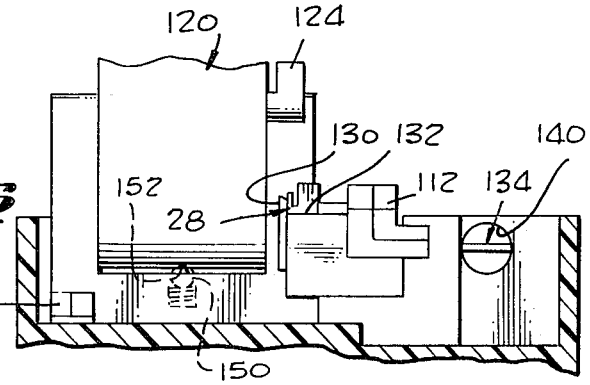
FIG. 16 is a view taken on the line 16—16 of FIG. 13.

As shown in FIG. 13, which shows details of one side of the installation tool, the arm 102 has a rearward portion 121 with a central recess 122 which receives the forward or mating portion 20 of the connector frame, with the rearward portion 22 projecting from the arm. The frame is inserted with one end lying behind a lower fixed member 124 and the other end lying behind a releasable upper member 126 which is spring biased towards the arm 102. The member 126 can be turned to the side for installing or removing a frame, and can be turned back so that a beveled surface 128 holds down an end of the connector frame and urges it against the lower member or stop 124. The blade 116 is designed to cut against another blade 130 which is positioned along a carrier-holding surface 132 where the carrier can be positioned, to cut the wires to length.

A cable containing many wires to be attached to the connector, may be installed on the clamp 110 by pivoting a clamp member 131 to the side about a downwardly biased pin 133 and returning the clamp member 130 to lie over the cable. The wires 14 then may be individually laced through slots of the holder 112 and through aligned grooves in the carrier and through the second holder 114. Each of the jigs such as 112 has a pair of jig parts with one part 112*a* lying behind the other 112*b*, and with the two jig parts having staggered wire-holding slots. The carrier 28 serves as a wire-holding jig, although the additional jig 112 is often useful to provide a more secure holding of the wires. The carrier is fixed in position with respect to base until the wires have been installed on the connector frame during the installation process. Each of the 50 wires of a typical telephone cable is normally marked by two colors, and each wire must be positioned in the proper carrier groove so it will be connected to the proper contact element of the connector. Proper installation of the wires is aided by a color chart device 134 which has chart surface or chart 134F with a lower row 136 of colors and an upper row 138 of colors. The proper grooves for each wire can be determined by positioning the wire so that it lies at a position where its two colors are the same as the two colors in the chart rows 136, 138. The chart device 134 is mounted on a rotatable holder 140 to permit it to be turned over for use with a male connector. One side of the chart device which contains the chart 134F, includes a central strip 142*f* of red color which identifies that chart as the one intended to be used for female connectors. The other side or chart 134 of the chart device has a different arrangement of colors and has a blue center strip 142*m* which identified that side as intended to be used for male connectors.

One type of mistake made in field installation of wires on a connector is the use of a wrong chart; that is, the use of a male lacing chart in the installation of wires on a female connector, or vice versa. Such an error can be easily made because the rear frame portions 22 of the male and female connectors are identical in shape and size, while the mating front connector portions 20 are hidden from view when the connectors are mounted on the installing arm. To minimize the possibility of such an error, the cap 42 on the rear wall of the female connector is formed of red plastic. The cap on a male connector (42M in FIG. 1) is correspondingly formed of blue plastic. Thus, a repairman can readily determine that the proper chart side is being displayed for the particular connector, by noting that the red cap 42 matches the red central lie 142*f* on the chart. This eliminates apprehension in the repairman that he may have the wrong chart displayed, and eliminates the need for him to remove the connector and check the front frame portion. Also, the matching red cap 42 and chart line 142*f* can automatically warn the repairman if he has forgotten to turn the chart to the proper side. It would be possible to construct an entire connector frame of red or blue plastic to indicate that it is a female or male type. However, it is often desirable to construct the main portion of the frame, which will be exposed after the hood is attached of a "conservative" color such as brown or grey that will be more acceptable in a business environment. Of course, the caps 42 or 42M will not be exposed in the final connector with the hood thereon.

Figure 15:
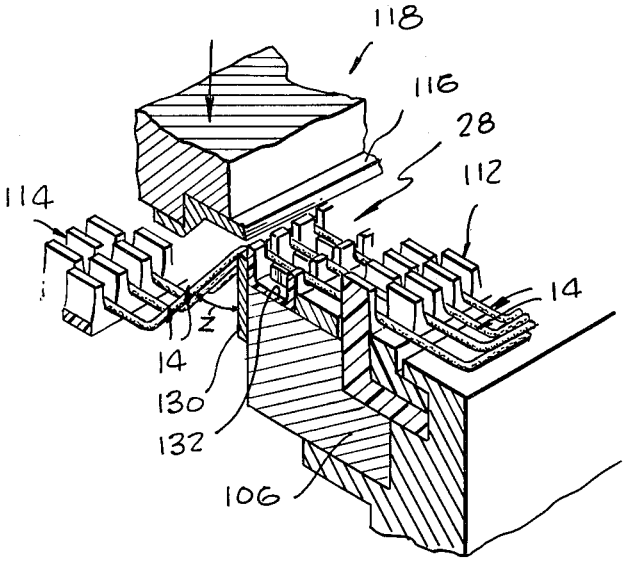
FIG. 15 is a partial perspective view of the tool of FIG. 13, shown during a stage of operation.
Figure 14:
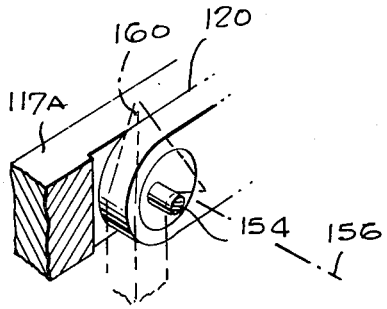
FIG. 14 is a partial perspective view of the tool of FIG. 13, shown during a stage of operation.

The installation arm 102 is retained in an upright position by an upwardly biased ball 150 (FIG. 13) that is urged by a spring into a recess 152 at the bottom of the arm. However, a person can easily force the arm to pivot to either side. As the arm pivots down, cutting of the wires is accomplished with only moderate downward force, because the wires are not all cut at the same time, but are cut one after the other as shown in FIG 15. However, the 25 wires are not pushed into the slots of the 25 corresponding contact elements, until the arm reaches its lower position, at which time all or a large number of the wires are pressed into their corresponding contact elements at the same time. It is normally difficult for a person to press down the installation arm 102 with sufficient force to install all 25 wires at the same time. To aid in the application of a high force, the upper part 118 of the installation arm is provided with a cam 154 in the form of a rod which is mounted a distance from the axis of pivoting 156 of the upper arm part 118 on the lower arm part 120. When the arm is pivoted down until the upper part is at the position shown in phantom lines 118A in FIG. 12 and in solid lines at 118A in FIG. 14, a hook 160 hooks over the cam 154. The hook 160 is pivotally mounted on a rod 162 (FIG. 12) and is urged by a spring 164 to pivot towards the center of the tool. Thus, as the installation arm is moved down, the hook 160 is deflected by the cam 154 and then hooks over the cam as shown in FIG. 14.

After the arm 102 has been moved down so its upper part is at position 118A and the hook 160 has engaged the cam 154, the operator moves a release lever 166 that permits the upper arm part 118 to pivot with respect to the lower part 120. The operator then lifts up the upper arm part to the position shown at 118B in FIG. 12. During such lifting, the cam 154 tends to push up on the hook 160, which causes the outer end of the lower arm part 120 to press down. This camming arrangement provides high leverage, so that with only a moderate lifting force on a handle 168 of the upper arm part, the operator causes the application of a large downward force to the outer end of the lower arm part 120, to firmly press the carrier 28 and all of the wires into the corresponding contact elements on the connector frame 18. The operator then lowers the upper part 118 to a horizontal position, pivots the hook 160 out of engagement with the cam 154, and raises the entire arm 102. The arm moves up, with the carrier and wires now being pulled up with the connector frame 18 to the central position. The operator then repeats the operation at the other side of the connector, to finish the installation. The connector frame with the wires attached thereto is removed from the installation tool, a hood may be attached over the rear frame portion, and the cable or bundle of wires 14 may be clamped by the hood to the connector frame.

Figure 12:
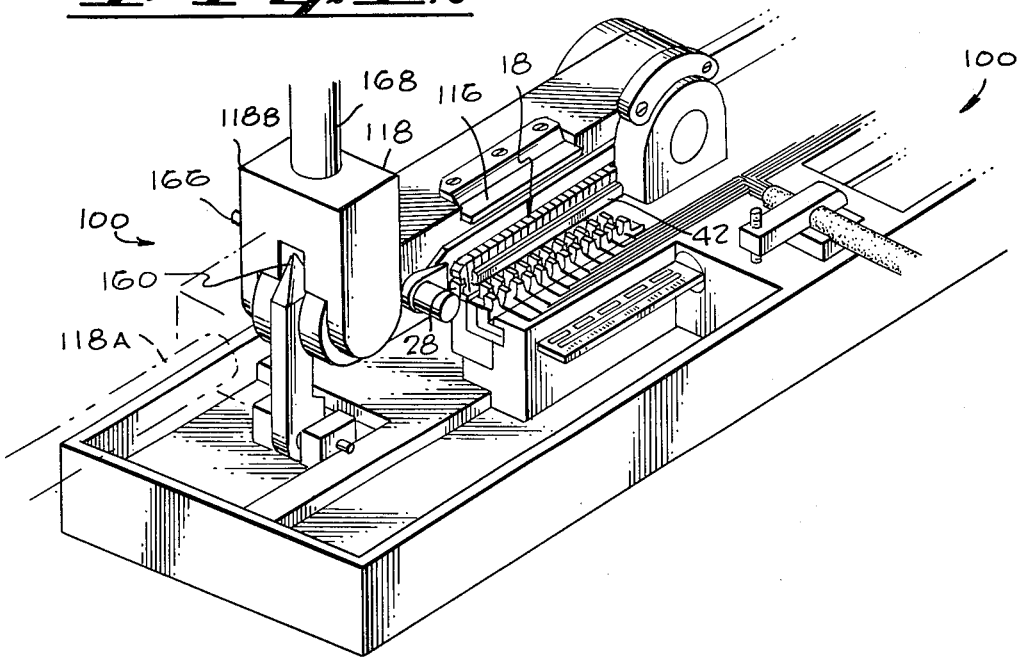
FIG. 12 is a perspective view of the tool of FIG. 11, shown at a later stage in the installation process.

When the arm 102 moves from the neutral or initial position shown in FIG. 11 towards the left portion 106*a* of the base, the leading side 102*a* of the arm must pivot beyond the jig 112 in order that the edges of the blades 116, 130 can pass across one another to cut the wires, and in order that the rearward portion of the connector frame can then reach and receive the cut ends of the wires held by the jig means or device formed by the jig 112 and carrier 28. Such movement of the arm could be prevented if the jig 114, that holds the forward ends of the cut wires which are not installed on the connector frame, were placed in the path of the arm. Such interference is prevented by locating the forward jig 114 so that it lies beside the path of the arm 102. Interference with arm movement could also be created by the wire itself along the wire portions which extend between the jig 114 and the carrier 28 and jig 112. It would be possible to prevent such interference by locating the cutting edge of the arm blade 116 ahead of the rest of the arm at its leading side 102*a*, but this would restrict the design of the arm. To avoid such design restrictions, the forward jig 114 is placed so it lies at a greater angle X from the neutral arm position than the angle Y of the carrier 28 and jig 112. Thus, the wires extend at an angle Z (FIG. 15) of less than 90° to the direction of arm movement, so that wire portions lie progressively further from the arm 102 at locations progressively closer to the forward jig 114. When the arm reaches the position occupied by the wire portions that extended between the jigs, the wires will have been cut and the cut ends can be easily pushed out of the way by the arm 102.

Thus, the invention provides an electrical connector installation tool and system for easily installing the wires on the elements. The installation tool includes an arm which can pivot to either side to cut and then begin installation of the carrier and wires of a connector frame, with the arm having two pivotally connected parts that can pivot to provide a camming action at the end of arm movement that forces the carrier against the connector frame with a high force. The wire-holding jigs are mounted with the forward jig 114 lying beside the path of the frame-holding arm, and with the forward jig lying at a greater angle from the initial or neutral arm position than the rearward jig. A pair of color-coded charts are provided which have color stripes identifying them as useful for either a male or female connector frame.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. Wire installation apparatus for installing a set of wires on a rearward portion of an electrical connector frame comprising:

a base;

a frame-holding device mounted on said base for holding a connector frame;

a wire-holding device mounted on said base, including a pair of spaced jig means for holding a plurality of wires in extension therebetween;

one of said devices being movably mounted on said base to move in a predetermined path towards the other device to enable said wires held by said wire-holding device to press against a connector frame held by said frame-holding device, and said frame-holding device having a leading portion which is closest to said wire-holding device as said devices approach one another;

first and second cutting blade means, each fixed with respect to a different one of said devices to pass closely across the other cutting blade means and sever wires extending between said pair of jig means prior to the severed wires pressing against a connector frame on said frame-holding device;

said pair of jig means being spaced apart, in a predetermined lateral direction perpendicular to the direction of movement of said movable device, by a distance greater than the depth along said predetermined direction of said leading portion of said frame-holding device, to allow said frame-holding device to move relative to said jigs far enough past the cutting blade means on the wireholding device to fully install the cut wire ends on the connector frame.

2. Wire installation apparatus for installing a set of wires (14) on a rearward portion (22) of an electrical connector frame (18) that has electrical contact elements (26) for receiving the wires, comprising:

a base (106);

a frame-holding arm (102) having a lower end pivotally mounted on said base to permit the arm to pivot sidewardly from a predetermined initial position towards the base, said arm having a rearward portion (121), and said arm having means (122) for holding a connector frame at a position spaced from the axis of pivoting (103) of the arm on the base and with a rearward portion (22) of the connector frame protruding from said rearward portion of the arm;

a pair of wire-holding jigs mounted on said base, a first of said jigs (112) lying rearward of a second of said jigs (114) for holding a plurality of wires in extension across the path of said arm when it pivots towards the base;

a first cutting blade (130) mounted on said base at a position forward of said first jig;

a second cutting blade (116) mounted on said arm to pass closely across said first blade when he arm pivots towards the base, for cutting the wire portions extending between said pair of jigs; and wire installing means disposed rearward of said first cutting blade for installing the cut ends of wires on the connector frame;

said pair of jigs (112,114) lying on opposite sides of the path of said arm.

3. The wire installation apparatus described in claim 2 wherein:

said wire installing means includes carrier holding means (132) disposed between said first jig and said first cutting blade, and a carrier (28) mounted on said carrier-holding means, said carrier having means for supporting wires that extend between said jigs, and said carrier having hook means (66) for attachment to a connector frame, whereby to help pull the wires out of the first jig (112) when the arm, with the connector frame thereon and with the wires and carrier on the connector frame, is returned to its neutral position.

4. An installation tool comprising:

a base;

an arm with a lower portion pivotally mounted on said base to allow said arm to move in a predetermined path, said arm having a rearward portion for holding a connector frame and having a first cutting blade located at a predetermined leading side of said rearward arm portion;

a second cutting blade mounted on said base beside the path of said first cutting blade when said arm pivots;

means defining a carrier holder located immediately rearward of said second blade;

a carrier having wire-holding grooves, said carrier removably mounted on said carrier holder, and said carrier having attaching means positioned for attaching to a connector frame on said arm;

a forward jig mounted at a location spaced forward of said second cutting blade and having a plurality of grooves; and a plurality of wires extending between said carrier and said forward jig and lying in said grooves thereof.

5. Wire installation apparatus for installing a set of wires on a rearward portion of an electrical connector frame, comprising:

a base, an arm having upper and lower arm parts which are pivotally connected, said lower part having a lower end pivotally mounted on said base to permit said arm to pivot from an initial position towards a second position close to said base, and said lower arm part having a connector holding device for holding an electrical connector frame;

a wire-holding jig device mounted on said base beside the path of said arm when said arm moves toward said second position, so that as the arm is moved toward said second position the connector frame and wires are brought close together to enable installation of the wires on the connector frame;

said upper arm part having an arm cam at its lower portion; and including a second cam mounted on said base in the path of said arm cam to engage said arm cam as said arm approaches said second position, said second cam being positioned to urge the top of said lower arm part towards said base as said upper arm part is pivoted with respect to said lower arm part, whereby to provide a large installation force urging said wires into said frame.

6. The apparatus described in claim 5 wherein:

said second cam includes a pivotally mounted member with a protruding portion which is deflected by said arm cam out of the path of said arm cam as said arm approaches said second position, and spring means which urges said protruding portion to pivot over said arm cam as said arm continues to approach said second position; and said upper arm part is upwardly pivotable with respect to said lower arm part when said lower arm part is substantially horizontal, and said arm cam is positioned so it tends to move upwardly when the upper arm part is pivoted up, whereby the second cam causes the arm cam and the upper end of the lower arm part to be pressed down.

7. A method for installing a plurality of wires on a rearward portion of an electrical connector frame, comprising:

mounting said connector frame, with the rearward connector frame portion thereof exposed, on a movable arm that cam move along a predetermined path from a predetermined neutral position to a second position;

mounting first and second locations along each wire at positions on either side of the path of said rearward connector frame portion when said arm moves along said path while leaving the region inbetween said positions unobstructed to arm movement;

moving said arm along said predetermined path from said neutral position toward said second position, severing said wires between said first and second locations thereof, and pressing the severed end portions of said wires which extend to said first locations thereof into said rearward frame portion;

said second locations on said wires being mounted at positions further from said neutral arm position, as measured along said arm path, than said first locations on said wires, whereby to prevent obstruction of arm movement.

8. An installation tool comprising:

holder means;

an arm with a portion pivotally coupled to said holder means to allow said arm to move relative to said holder means in a predetermined path, said arm having a rearward portion for holding a connector frame and having a first cutting blade located at a predetermined leading side of said rearward arm portion;

a second cutting blade mounted on said holder means beside the path of said first cutting blade when said arm pivots;

means defining a carrier holder mounted on said holder means and located immediately rearward of said second blade;

a carrier having wire-holding grooves, said carrier removably mounted on said carrier holder, and said carrier having attaching means positioned for attaching to a connector frame on said arm; and a plurality of wires extending through said grooves of said carrier and lying over said second cutting blade, whereby when the arm pivots to move the connector frame against and then away from the holder means, the arm picks up the carrier and the wires held in the grooves of the carrier.

9. The tool described in claim 8 including:

a connector frame held in a predetermined position on said arm, said connector frame having a pair of first hooking means; and wherein said carrier has a pair of second hooking means; and said carrier holder holds said carrier at a predetermined position so that said second hooking means is in the path of said first hooking means on said connector frame, said first and second hooking means constructed to automatically interlock when said connector frame is moved against said carrier.

* * * * *